US009903031B2

(12) United States Patent
Takeuchi

(10) Patent No.: US 9,903,031 B2
(45) Date of Patent: Feb. 27, 2018

(54) PRODUCTION METHOD FOR ELECTRODE FOR ELECTROLYSIS

(71) Applicant: PERMELEC ELECTRODE LTD., Fujisawa-shi, Kanagwa (JP)

(72) Inventor: Atsumi Takeuchi, Fujisawa (JP)

(73) Assignee: DE NORA PERMELEC LTD, Fujisawa-Shi, Kanagawa (JP)

( * ) Notice: Subject to any disclaimer, the term of this patent is extended or adjusted under 35 U.S.C. 154(b) by 0 days.

(21) Appl. No.: 14/436,342

(22) PCT Filed: Sep. 4, 2014

(86) PCT No.: PCT/JP2014/073290
§ 371 (c)(1),
(2) Date: Apr. 16, 2015

(87) PCT Pub. No.: WO2015/033989
PCT Pub. Date: Mar. 12, 2015

(65) Prior Publication Data

US 2015/0259811 A1 Sep. 17, 2015

(30) Foreign Application Priority Data

Sep. 6, 2013 (JP) ..... 2013-185589

(51) Int. Cl.
*C25B 11/04* (2006.01)
*C25B 11/03* (2006.01)
(Continued)

(52) U.S. Cl.
CPC ..... *C25B 11/0478* (2013.01); *C23C 18/06* (2013.01); *C23C 18/08* (2013.01);
(Continued)

(58) Field of Classification Search
CPC ..... C25B 11/035; C25B 11/0405; C25B 11/0478; C25B 11/03; H01M 4/02; H01M 4/0404; H01M 4/0416
(Continued)

(56) References Cited

U.S. PATENT DOCUMENTS 3,385,736 A * 5/1968 Deibert ..... C22C 32/00 264/104
4,326,943 A 4/1982 Banziger et al.
(Continued)

FOREIGN PATENT DOCUMENTS

JP 59-64788 4/1984
JP 3-253590 11/1991
(Continued)

OTHER PUBLICATIONS

International Search Report, dated Dec. 2, 2014; PCT/JP2014/073290 (2 pages).
(Continued)

*Primary Examiner* — Tabassom Tadayyon Eslami
(74) *Attorney, Agent, or Firm* — Hamre, Schumann, Mueller & Larson, P.C.

(57) ABSTRACT

The present invention provides a method for manufacturing an electrolytic electrode, the method capable of appropriately controlling the amount of an electrode catalyst component as desired and also capable of manufacturing a high-performance electrolytic electrode in a cost-effective and efficient way without affecting the electrode performance. A method for manufacturing an electrolytic electrode including a step of forming an electrode catalyst layer on each of a front and a back of a conductive electrode substrate, by applying a coating solution containing a starting material for the electrode catalyst component on the front of the conductive electrode substrate with a plurality of
(Continued)

holes, the conductive electrode substrate being expanded mesh or the like, and thereafter drying and firing the coating solution, wherein the substrate contains at least one metal selected from the group consisting of Ti, Ta, Nb, Zr, Hf, and Ni, and alloys thereof, the electrode catalyst component contains at least one selected from the group consisting of Pt, Ir, Ru, Pd, Os, and oxides thereof, and an amount of the electrode catalyst component adhering to the back of the substrate is controlled by preheating the substrate to a temperature higher than room temperature at least once before the coating solution is applied and/or by presetting the temperature to which the substrate is preheated in the electrode catalyst layer-forming step.

6 Claims, 3 Drawing Sheets

(51) Int. Cl.
*C23C 18/06* (2006.01)
*C23C 18/08* (2006.01)
*C23C 18/12* (2006.01)
*C23C 18/16* (2006.01)

(52) U.S. Cl.
CPC ..... *C23C 18/1216* (2013.01); *C23C 18/1283* (2013.01); *C23C 18/1291* (2013.01); *C23C 18/1644* (2013.01); *C25B 11/03* (2013.01); *C25B 11/0484* (2013.01); *C25B 11/0494* (2013.01)

(58) Field of Classification Search
USPC ..... 427/97.8
See application file for complete search history.

(56) References Cited

U.S. PATENT DOCUMENTS

| | | | | |
|---|---|---|---|---|
| 5,958,197 | A | 9/1999 | Allen et al. | |
| 6,376,118 | B1 | 4/2002 | Bruck et al. | |
| 2011/0223502 | A1* | 9/2011 | Maruyama | C01B 3/40 429/420 |
| 2013/0108802 | A1* | 5/2013 | Oladeji | H01M 4/0471 427/565 |

FOREIGN PATENT DOCUMENTS

| | | | |
|---|---|---|---|
| JP | 4453973 | B | 4/2010 |
| JP | 2010-140718 | | 6/2010 |
| JP | 2011-181511 | | 9/2011 |
| JP | 2010-14718 | * | 4/2016 |

OTHER PUBLICATIONS

Extended European Search Report issued in the corresponding European patent application No. 14843061.4, dated Jun. 22, 2016, 7 pages.

Park et al., A study on the Preparation of the Dimensionally Stable Anode (DSA) with High Generation Rate of Oxidants (II), Journal of Environmental Sciences, vol. 61, No. 72, 2009, pp. 61-72.

Korean Office Action issued in the corresponding Korean patent application No. 10-2015-7011388, dated Apr. 27, 2016, 5 pages.

* cited by examiner

[Figure 1]
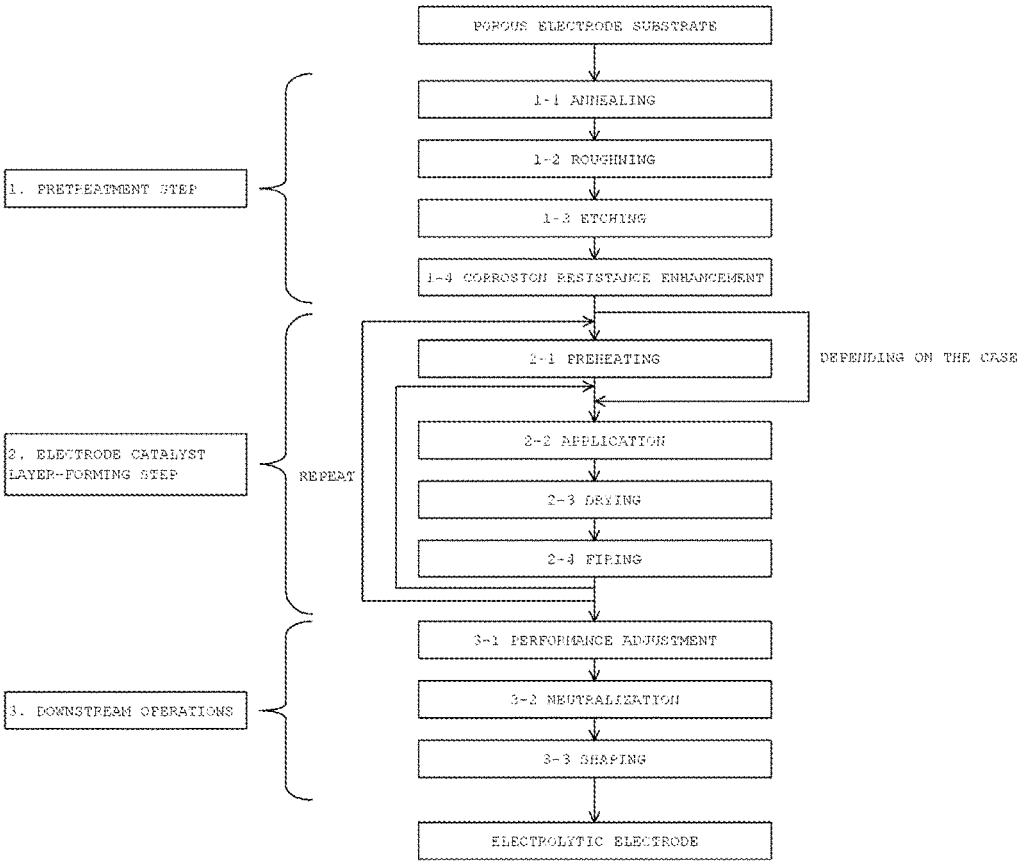

[Figure 2]
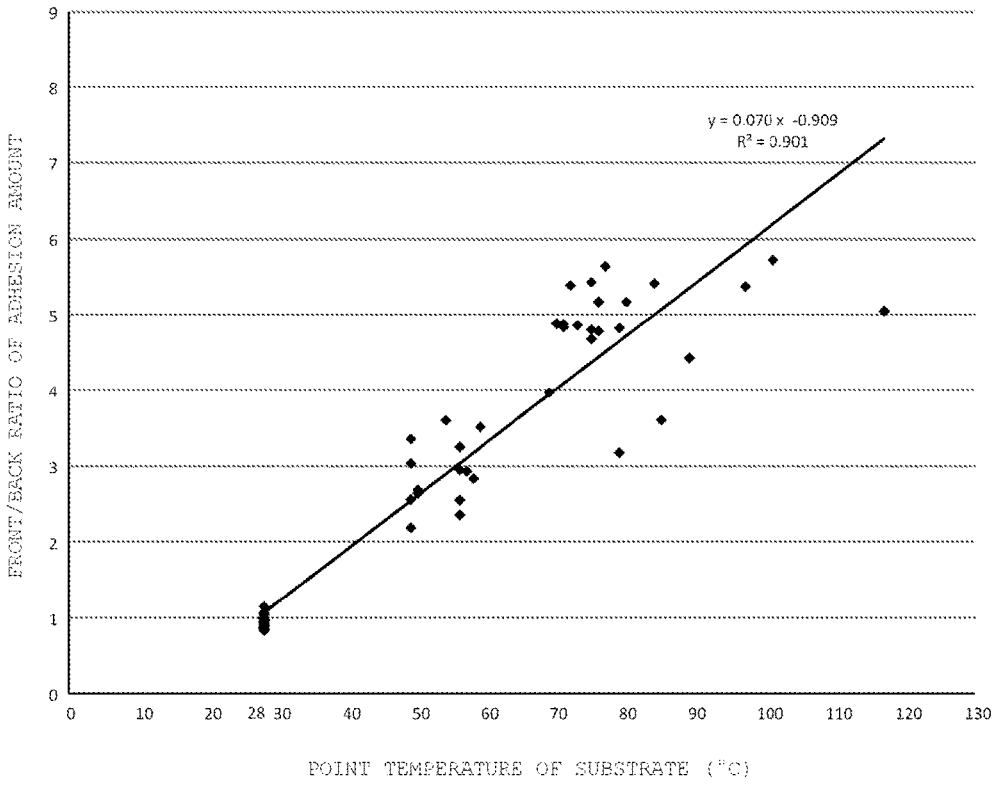

[Figure 3]
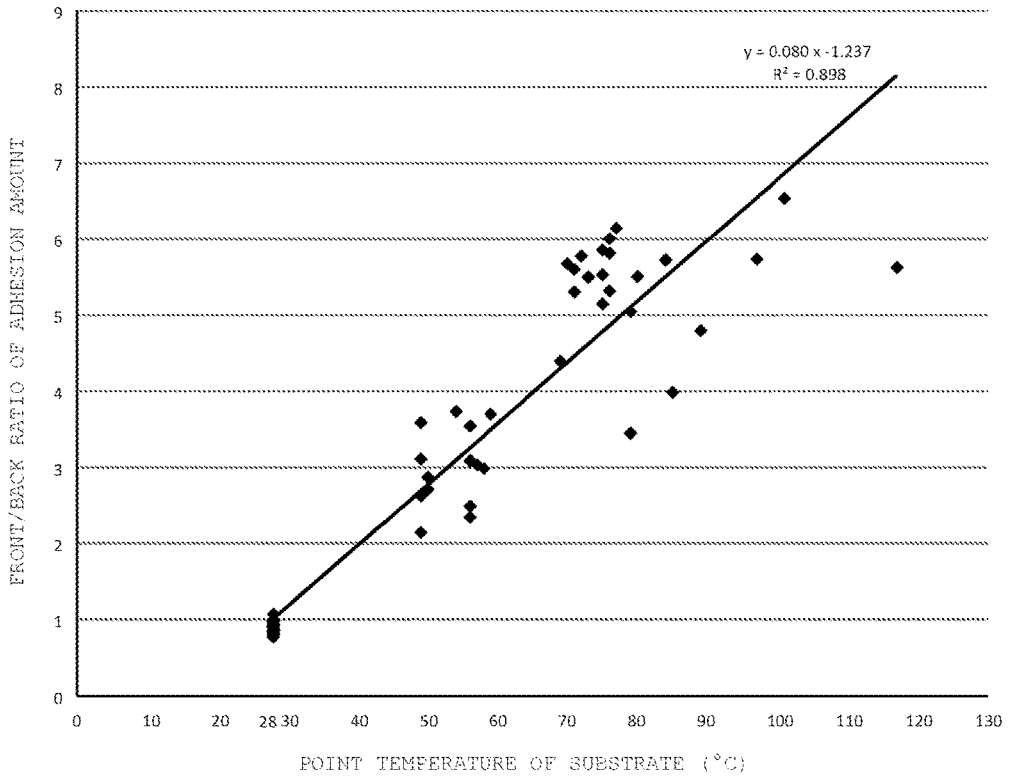

PRODUCTION METHOD FOR ELECTRODE FOR ELECTROLYSIS

TECHNICAL FIELD

The present invention relates to a method for manufacturing an electrolytic electrode that can be used as an anode and/or a cathode of electrolytic cells in various industrial electrolytic processes that involve electrolytic sodium hydroxide production, water electrolysis, or oxygen or chlorine production, the electrolytic electrode obtained by forming an electrode catalyst layer on a conductive electrode substrate with a plurality of holes that is expanded mesh, a punched perforated plate, or wire netting or any object that has a similar shape.

BACKGROUND ART

The anode and the cathode of such an electrolytic cell are immersed in an electrolytic solution when used in various electrolytic processes. They can be used in various arrangements: for example, they may be separate from each other in a diaphragmless electrolytic cell, they may be placed on both sides of a diaphragm or an ion-exchange membrane away from the diaphragm or membrane, they may be used in a finite-gap electrolytic cell, in which the two electrodes are placed on both sides of a diaphragm or an ion-exchange membrane with a minimum distance from the diaphragm or membrane, or they may be used in a zero-gap electrolytic cell, in which an ion-exchange membrane is sandwiched between the two electrodes with no space left. In all of such cases, the side of the anode and the cathode that faces the diaphragm or ion-exchange membrane is the site for the main reaction and is defined as the front, while the other side the back.

Electrolytic electrodes for ion-exchange membrane electrolysis, in particular, the anode and the cathode of a finite- or a zero-gap electrolytic cell, are produced using a conductive electrode substrate with a plurality of holes that is expanded mesh, a punched perforated plate, or wire netting or an object having a similar shape. The ordinary method for producing such an anode and a cathode includes intentionally forming an electrode catalyst layer on either side, or the front, of two faces of the conductive electrode substrate with a plurality of holes and placing the electrode substrates on both sides of an ion-exchange membrane with their front facing the membrane with no or only a minimum space provided.

For electrolytic sodium hydroxide production, researchers have proposed many different ion-exchange membrane alkali chloride electrolytic cells that can produce high-purity alkali metal hydroxides at high current efficiency and low voltage, in particular, filter-press zero-gap electrolytic cells, in which the ion-exchange membrane is sandwiched between the anode and the cathode with no space left. A filter-press zero-gap electrolytic cell is composed of many bipolar structures arranged with cation-exchange membranes therebetween, and each bipolar structure has an anode chamber and a cathode chamber positioned with their back facing each other. The cathode chamber contains a hydrogen-producing cathode that is in contact with the cation-exchange membrane, and the anode chamber contains a chlorine-producing anode that is in contact with the other side of the cation-exchange membrane.

The substrate of the anode of this kind of electrolytic cell is usually made of a titanium-based material, and that of the cathode is usually made of nickel or a nickel alloy. The anode and the cathode are both produced using a conductive electrode substrate with a plurality of holes that is expanded mesh, a punched perforated plate, or wire netting or an object that has a similar shape (hereinafter also collectively referred to as a conductive substrate with a plurality of holes). One side of such a substrate is coated with an electrode catalyst layer that contains an electrode catalyst component composed of an expensive and rare platinum-group metal and/or its oxide (hereinafter, also referred to as a platinum-group metal or the like), and this side of the electrode is used for the main reaction and defined as the electrode's front.

Patent Literature 1 discloses a method for manufacturing an electrolytic electrode for zero-gap electrolytic cells, and a category of the electrolytic cells is the one in which an ion-exchange membrane is sandwiched between the anode and the cathode with no space left. The publication specifies, for example, the thickness and the open area ratio of the conductive substrate with a plurality of holes, the thickness of the electrode catalyst layer, and the surface roughness of the electrode for each of an anode and a cathode, and also mentions pretreatments such as annealing, shaping, flattening by rolling, roughening by blasting, washing and etching with an acid, and corrosion resistance enhancement.

In known manufacturing methods, usually, a conductive substrate with a plurality of holes that has the aforementioned shape is subjected to pretreatments such as annealing, shaping, flattening by rolling, roughening by blasting, washing and etching with an acid, and corrosion resistance enhancement, and then its front is coated with an electrode catalyst layer that contains an electrode catalyst component composed of an expensive platinum-group metal or the like. The step of forming the electrode catalyst layer is referred to as activation step, and the activation step usually includes three steps: applying a coating solution that contains a starting material from which the electrode catalyst component can be derived (hereinafter also referred to as the starting material) to the substrate and then drying and firing the obtained coating layer. More specifically, in a typical activation step, a coating solution prepared by dissolving the starting material is applied to the front of the conductive substrates with a plurality of holes after pretreatments such as those mentioned above, and then the obtained coating layer is dried and fired to form an electrode catalyst layer. The electrode catalyst layer is then grown to the desired thickness by repeating the three operations, i.e., application, drying, and firing, several times until as much of the electrode catalyst component as required adheres to the front of the conductive electrode substrate. In this way, the electrode catalyst layer that contains an electrode catalyst component composed of an expensive platinum-group metal or the like (hereinafter also referred to as the catalyst layer substance) is formed. Usually, the coating solution is applied to the substrate by means such as spraying, brushing, and electrostatic coating, and the dried coating layer is fired by heating usually in an electric furnace or similar devices.

CITATION LIST

Patent Literature

Patent Literature 1: Japanese Patent Publication No. 4453973

SUMMARY OF INVENTION

Technical Problem

The inventor has found the following problems with the related art described above. In the above known method, the substrate as the base to form the electrode catalyst layers for the anode and the cathode is expanded mesh, a punched perforated plate, or wire netting or an object that has a similar shape. A coating solution that contains the starting material is applied to the front of the substrate by the method described above, which causes a considerable amount of the coating solution reaches and adheres to the back of the substrate because the applied coating solution can migrate from the front of the substrate to the back through the many pores or via the edge of the substrate. The subsequent drying and firing therefore fix the electrode catalyst component not only to the front of the conductive substrate with a plurality of holes but also on the back of the substrate in an equal amount, or occasionally in a greater amount, which causes the electrode catalyst layer to involve the back of the substrate.

Furthermore, the electrode catalyst component used in the anode and the cathode of electrolytic cells of the aforementioned type is at least one selected from platinum, iridium, ruthenium, palladium, osmium, and oxides thereof. These materials, usually used to make jewelry and other fashion accessories, are rare and highly expensive, and their prices have been rising year by year. Vast amounts of electrolytic cells of this type are used in large electrolytic facilities such as those in petrochemical complexes, and the costs related to the electrode catalyst component constitute a very high percentage in the total costs for the cells. It is certainly one of the industry's most urgent tasks to cut down the costs associated with the use of such materials for the electrode catalyst component.

When the conductive substrate with a plurality of holes, for which some examples are given above, as the base for the anode or the cathode is thin, the electrode catalyst component in the electrode catalyst layer formed on the back of the substrate is as effective as that in the electrode catalyst layer on the front. For both the anode and the cathode, however, the main reaction occurs on the front of the electrode, and the electrode catalyst layer on the front of the electrode is consumed faster than that on the back; the amount of the electrode catalyst component rapidly drops on the front as compared with that on the back. This means that when the amount of the electrode catalyst component (hereinafter also referred to as the electrode catalyst content) before the start of electrolysis is equal in the electrode catalyst layer on the front of the electrode and in that on the back, the electrode catalyst content on the front decreases over time to the minimum amount required, while much of the electrode catalyst component on the back remains unused even after the life of the electrode has expired. The remaining raw material components for the electrode catalyst component go to waste without being effectively used, which causes a huge economic loss. This is certainly fatal to the entire production cycle under the current situation in which raw materials for the electrode catalyst component are highly expensive. However, such an electrode cannot be produced with no electrode catalyst layer on its back because the minimum electrode catalyst content required is about 20% of the initial content and the electrode catalyst layer should be designed to remain on the front and the back of the conductive electrode substrate in an amount corresponding to this limit after the completion of electrolysis.

The inventor has extended these findings and figured out how a more cost-effective electrolytic electrode can be designed. The electrode catalyst content in the electrode catalyst layer should be controlled on both the front and the back of the substrate in the way described below, and it is important to find an easy way to control the amount of the electrode catalyst component that adheres and is fixed to the surfaces of the substrate (the amount of adhesion). More specifically, the inventor has assumed that it is effective to form the electrode catalyst layer by depositing the electrode catalyst component on the conductive electrode substrate while ensuring that the electrode catalyst content on the front of the substrate and that on the back decrease to such a limit over substantially equal periods of time, or in other words roughly at the time when the electrolytic cell has been used and electrolysis has been completed, because the electrode catalyst component is consumed (the electrode catalyst content decreases) at different rates on the front and the back of the substrate and these rates also vary depending on the electrolytic conditions and/or the sort of the electrode catalyst component used. This approach requires controlling the amount of the electrode catalyst component that adheres to the back of the substrate while considering the initial amount of the electrode catalyst component on the front before starting electrolysis. The requirements for the amount of adhesion of the electrode catalyst component to be ideal for both cost-effectiveness and performance are therefore as follows:

1) The amount of the adhering electrode catalyst component should be larger on the front of the conductive electrode substrate than on the back; and 2) The amount of the adhering electrode catalyst component should be controlled on both the front and the back of the substrate in accordance with the rates of consumption of the electrode catalyst component on the front and the back, which vary depending on the conditions under which the electrolytic electrode is used and the sort of the electrode catalyst component used, so that only a minimum amount required or moderate amount of the electrode catalyst component goes through the many pores or via the edge of the substrate and adheres to the back of the substrate when the coating solution is applied to the front.

The known method, however, appears to have been invented without recognition of such a problem and, therefore, without discussion for a solution to such a problem. The electrode catalyst component used in the known method, selected from platinum, iridium, ruthenium, palladium, osmium, and oxides thereof, is highly expensive. Nevertheless, no attempts have even been made to reduce the amount of the electrode catalyst component that adheres to the back of the substrate. After searching other fields of technology, the inventor found that the related art, including Patent Literature 1, did not disclose or suggest the requirements (1) and (2) for the amount of adhesion of the electrode catalyst component on the front and the back of the conductive substrate to be ideal for both cost-effectiveness and performance or any method, means, solution, or discussion that would allow these requirements to be fulfilled.

An object of the present invention is therefore to minimize the consumption of such expensive raw materials for the electrode catalyst component without affecting the performance of the electrode, which is an object not disclosed or suggested in the known method, and another is to find a new technology for that purpose. By such a technology, an electrode catalyst layer can be formed on a conductive electrode substrate with a plurality of holes that is expanded mesh, a punched perforated plate, or wire netting or an object that has a similar shape with the amount of adhesion of the electrode catalyst component on the front and the back of the substrate controlled with ease. In other words, an object of the invention is to provide a method for manufacturing an electrolytic electrode and focuses on a simple control process that ensures more of the electrode catalyst component adheres to the front of the substrate of the electrode, i.e., the surface as the site for the main reaction, than on the back and minimizes the amount of the electrode catalyst component that adheres to the back of the substrate. Achieving these objects leads to the availability of a manufacturing method that provides several advantages to the production of electrolytic electrodes, including the following: the amount of use of expensive electrode catalyst components that contain a platinum-group metal or the like can be effectively reduced; the consumption of expensive raw materials for the electrode catalyst component can be minimized without affecting the functionality of the electrodes; as a result, it becomes possible to manufacture high-performance electrolytic electrodes in an efficient and cost-effective manner.

Solution to Problem

To achieve the aforementioned objects, a first solving means according to the present invention provides a method for manufacturing an electrolytic electrode comprising:

an electrode catalyst layer-forming step of forming an electrode catalyst layer containing an electrode catalyst component on each of a front and a back of a conductive electrode substrate by applying a coating solution containing a starting material for the electrode catalyst component on the front of the conductive electrode substrate with a plurality of holes being expanded mesh, a punched perforated plate, or wire netting or an object having a similar shape (excluding the case where the conductive electrode substrate is a fired body obtained by firing a metal powder or metal fiber, or a metal woven fabric), and thereafter drying and firing the coating solution, wherein the conductive electrode substrate comprises at least one metal selected from the group consisting of titanium, tantalum, niobium, zirconium, hafnium, and nickel, and alloys thereof, the electrode catalyst component comprises at least one selected from the group consisting of platinum, iridium, ruthenium, palladium, osmium, and oxides thereof, the conductive electrode substrate is preheated at least once in the electrode catalyst layer-forming step to a temperature higher than room temperature immediately before the coating solution is applied to the front of the substrate, and the temperature of the conductive electrode substrate immediately before the coating solution is applied to the front of the substrate is preset by the preheating to control an amount of the electrode catalyst component adhering to the back of the conductive electrode substrate.

To achieve the aforementioned objects, a second solving means according to the present invention provides the method for manufacturing an electrolytic electrode, wherein the conductive electrode substrate immediately before the coating solution is applied is at a temperature of 35° C. to 120° C.

To achieve the aforementioned objects, a third solving means according to the present invention provides the method for manufacturing an electrolytic electrode, wherein the conductive electrode substrate immediately before the coating solution is applied is at a temperature of 35° C. to 70° C.

To achieve the aforementioned objects, a fourth solving means according to the present invention provides the method for manufacturing an electrolytic electrode, wherein a ratio (A/B) of an amount (A) of the electrode catalyst component adhering to the front of the conductive electrode substrate to the amount (B) of the electrode catalyst component adhering to the back of the conductive electrode substrate is arbitrarily controlled within a range from 1.5 to 6.8.

To achieve the aforementioned objects, a fifth solving means according to the present invention provides the method for manufacturing an electrolytic electrode, wherein the ratio (A/B) is arbitrarily controlled within a range from 1.5 to 4.4.

To achieve the aforementioned objects, a sixth solving means according to the present invention provides the method for manufacturing an electrolytic electrode, wherein the amount of the electrode catalyst component adhering to the back of the conductive electrode substrate is controlled by presetting the number of times of preheating the conductive electrode substrate in the catalyst layer-forming step.

Advantageous Effects of Invention

According to the present invention, it becomes possible to control the amount of the electrode catalyst component adhering to the back of the conductive electrode substrate by an extremely simple method, namely, a method for manufacturing an electrolytic electrode comprising: an electrode catalyst layer-forming step of forming an electrode catalyst layer containing an electrode catalyst component on each of a front and a back of a conductive electrode substrate by applying a coating solution containing a starting material for the electrode catalyst component on the front of the conductive electrode substrate with a plurality of holes being expanded mesh, a punched perforated plate, or wire netting or an object having a similar shape (excluding the case where the conductive electrode substrate is a fired body obtained by firing a metal powder or metal fiber, or a metal woven fabric), and thereafter drying and firing the coating solution, wherein the conductive electrode substrate comprises at least one metal selected from the group consisting of titanium, tantalum, niobium, zirconium, hafnium, and nickel, and alloys thereof, the electrode catalyst component comprises at least one selected from the group consisting of platinum, iridium, ruthenium, palladium, osmium, and oxides thereof, the conductive electrode substrate that is at a room temperature (ambient temperature or normal temperature) is preheated at least once in the electrode catalyst layer-forming step to a temperature higher than room temperature immediately before the coating solution is applied to the front of the substrate, and the temperature of the conductive electrode substrate immediately before the coating solution is applied to the front of the substrate is preset by the preheating and by the method, the following remarkable effects can be obtained. That is to say, the consumption of the electrode catalyst component that is an expensive raw material can be minimized, and as a result thereof, high-performance electrolytic electrode can be manufactured economically and efficiently without impairing the electrode performance. More specifically, the manufacturing method according to the present invention is advantageous in that various adjustments can be made by appropriately designing the preheating in terms of temperature and/or the number of times of preheating, and one of such adjustments is to control the amount of the catalyst layer substance fixed to the front of the substrate by making the coating solution on the substrate dry faster and reducing the time the catalyst layer substance in the solution takes to be fixed to the front of the substrate. In this method, therefore, it is easy to adjust the ratio of the amount of adhesion of the electrode catalyst component on the front of the conductive electrode substrate with a plurality of holes to that on the back while ensuring that the front of the conductive substrate retains more of the electrode catalyst component than the back, for example. As a result, the consumption of expensive raw materials for the electrode catalyst component can be minimized without affecting the functionality of the electrodes.

The preheating conducted in the present invention can be, for example, heating the conductive electrode substrate, with or without pretreatment, to a temperature higher than room temperature (ambient temperature, or normal temperature) immediately before applying the coating solution containing a starting material for the electrode catalyst component to the front of the substrate. Through research the inventor has found that heating the conductive electrode substrate to a temperature higher than room temperature (ambient temperature, or normal temperature) immediately before forming a layer of the coating solution makes the coating solution, which contains a starting material for the electrode catalyst component, dry faster on the front of the substrate and, therefore, makes the catalyst layer substance (electrode catalyst component) in the applied coating solution more rapidly fixed to the front of the substrate. This can be used to control the amount of the electrode catalyst component that migrates to the back of the substrate through the pores or other routes. This way of control effectively limits the amount of the electrode catalyst component that migrates and is fixed to the back of the substrate and allows an efficient electrode catalyst layer to be formed on the back of the substrate.

BRIEF DESCRIPTION OF DRAWINGS

FIG. 1 is a flow diagram illustrating a typical embodiment of the method for manufacturing an electrolytic electrode according to the present invention.

FIG. 2 is a graph showing the ratio of the amount of adhesion of ruthenium between the front and the back of conductive electrode substrates versus the temperature of the substrates measured after preheating, which is a feature of the present invention, and immediately before application.

FIG. 3 is a graph showing the ratio of the amount of adhesion of iridium between the front and the back of conductive electrode substrates versus the temperature of the substrates measured after preheating, which is a feature of the present invention, and immediately before application.

DESCRIPTION OF EMBODIMENTS

The following describes a preferred embodiment of the method for manufacturing an electrolytic electrode according to the present invention with reference to the Drawings.

FIG. 1 is a flow diagram illustrating a typical manufacturing process of the method for manufacturing an electrolytic electrode according to the present invention. Specifically, the first step, pretreatment, in which a conductive electrode substrate for forming an electrode catalyst layer is subjected to several pretreatments, is carried out on an as-needed basis and is not essential for the present invention. The electrode catalyst layer-forming step that follows the pretreatment step is a feature of the present invention. That is to say, importantly, the electrode catalyst layer-forming step includes preheating the substrate at the right time at least once, and this preheating is not included in the known method and provides the aforementioned great advantages of the present invention. The step of downstream operations that follows the electrode catalyst layer-forming step is also performed on an as-needed basis and is not essential for the present invention. The following describes the details of the individual steps.

(Conductive Electrode Substrate)

The conductive electrode substrate used in the present invention is expanded mesh, a punched perforated plate, or wire netting or a plate with a plurality of holes having a similar shape. However, it is a matter of course that the plates with a plurality of holes do not include: a fired body obtained by firing a metal powder or metal fiber; and metal woven cloth, in which there is not a possibility that the coating solution applied on the front of the substrate migrates to the back. When the electrode is to be used as an anode, it is preferred that the conductive electrode substrate with a plurality of holes is made of either at least one selected from valve metals such as titanium, tantalum, niobium, zirconium, and hafnium or alloys thereof. When the electrode is to be used as a cathode, the conductive electrode with a plurality of holes is preferably made of nickel, a nickel alloy, or a similar material. The specific surface area (actual surface area per 1 $m^2$ of projected area) and the thickness of the conductive electrode substrate are roughly in the range of 1.6 to 2.5 m2 and 0.5 to 3.0 mm, respectively, for anodes and roughly in the range of 1.1 to 2.4 $m^2$ and 0.1 to 0.8 mm, respectively, for cathodes.

(1. Pretreatment)

Such a conductive electrode substrate with a plurality of holes for use in the present invention may be subjected to appropriate pretreatments if necessary. Pretreatments such as annealing, shaping, surface roughening, etching, and corrosion resistance enhancement can be performed for purposes such as improving the condition of the surface of the substrate. Specifically, it is preferred that the substrate is subjected to at least the treatments described below; however, the selection of the appropriate treatments depends on the material used to make the conductive electrode substrate and the steps that follow. The following illustrates each preferred pretreatment of the conductive electrode substrate used in the present invention.

[1-1 Annealing]

In a batch heating furnace filled with air, the conductive electrode substrate is annealed while maintaining its actual temperature in the range from 580° C. to 600° C. for at least 1 hour, and then the substrate is allowed to cool to about 200° C. in the furnace. The substrate is then removed from the furnace and allowed to cool in the air.

[1-2 Surface Roughening]

The annealed conductive electrode substrate is shaped as necessary. Then, for example, an alumina abrasive having a particle size distribution of 250 to 212 μm or 40.0±2.5 μm is sprayed over both sides of the conductive electrode substrate with a pressure of 0.3 to 0.5 MPa to make both sides of the substrate rough.

[1-3 Etching]

If the surface of the conductive electrode substrate is roughened in such a way, no abrasive should be carried over from the surface roughening. Thus, the roughened substrate is immersed in a solution containing about 18 to 22 wt. % hydrochloric acid or any other mineral acid and has been heated to about 100° C. to 109° C., until a predetermined amount of the substrate is lost. Through such a treatment the abrasive that remains in the conductive electrode substrate is removed, and at the same time the surface of the substrate is etched.

[1-4 Corrosion Resistance Enhancement]

Several methods are possible to enhance the corrosion resistance of the conductive electrode substrate. An example of such a method is described below. Note that titanium and zirconium, which are materials commonly used to make electrode substrates, form stable oxide coatings at ordinary temperatures and thus are highly resistant to corrosion. The coating solution used in the electrode catalyst layer-forming step described hereinafter is an inorganic or organic solution containing the electrode catalyst component, and these two metals are unlikely to be damaged when exposed to such a solution. For this reason, there is little need for corrosion resistance enhancement when the substrate is made of these materials. When the conductive electrode substrate is made of materials other than titanium and zirconium, however, the substrate may be prone to corrosion by the coating solution, and it is preferred to have the substrate forma firm, dense, and corrosion-resistance oxide coating on its surface by heating the substrate at a high temperature before applying the coating solution to it. For example, when the substrate is made of nickel, the substrate may be heated at about 500° C. for not more than 30 minutes in the air.

(2. Electrode Catalyst Layer-Forming Step)

As illustrated in FIG. 1, the present invention features an electrode catalyst layer-forming step, in which an electrode catalyst layer is formed on the surface of the conductive electrode substrate with a plurality of holes, which may optionally be subjected to pretreatments such as those described above. The electrode catalyst layer-forming step is similar to the known method for the electrode catalyst layer-forming step in the manufacture of electrolytic electrodes, except that the substrate is preheated at least once. More specifically, in the known method, the electrode catalyst layer is formed on the surface of a conductive electrode substrate with a plurality of holes by applying a coating solution containing a starting material for the electrode catalyst component to one side, or more specifically the front, of the substrate, then drying and firing the obtained coating layer, and repeating this cycle of application, drying, and firing several times until the electrode catalyst layer on the surface of the substrate contains a desired amount of the electrode catalyst component. The method according to the present invention is basically similar to this. In the manufacturing method according to the present invention, however, the conductive electrode substrate is preheated to a temperature equal to or higher than room temperature at least once before the coating solution is applied to it, or prior to at least one application-drying-firing cycle when this cycle is repeated.

The following outlines this point with reference to FIG. 1. As mentioned above, the present invention allows one to form the electrode catalyst layers on the front and the back of the substrate while separately controlling the electrode catalyst content in the respective electrode catalyst layers by appropriately determining when and how many times to preheat the substrate. This is based on the following findings. The inventor has found that when a coating solution is applied to the front of a conductive electrode substrate, preheating the substrate makes the applied coating solution dry faster and reduces the time the catalyst layer substance in the solution takes to be fixed to the front of the substrate. By preheating the substrate, therefore, one can reduce the amount of the coating solution that moves to the back of the substrate through the pores or other routes and thus can effectively control the amount of the catalyst layer substance that migrates and is fixed to the back of the substrate. The inventor has also confirmed that preheating a conductive electrode substrate and then applying a coating solution to it, followed by drying and firing, results in a markedly higher electrode catalyst content in the electrode catalyst layer on the front of the substrate than that in the electrode catalyst layer formed on the back of the substrate by the solution moving through the pores or other routes, compared with applying the coating solution to an unheated substrate.

As illustrated in FIG. 1, the method according to the present invention includes preheating the substrate at least once before applying the coating solution to it; it is possible that the substrate is preheated before each of several rounds of application or every time before the application. The substrate is not necessarily preheated before the first round of application. For example, the substrate may be preheated after the first application-drying-firing cycle has been completed, rather than being preheated before the first round of application. It is also possible to complete several application-drying-firing cycles first and then preheat the substrate before the last cycle. Furthermore, the requirement that the substrate be preheated at least once means that the substrate may be preheated before each round of application, i.e., every time before the application. Through research the inventor has verified that by adjusting when and how many times to preheat the conductive electrode substrate, one can control how much of the coating solution containing a starting material for the electrode catalyst component adheres to the back of the substrate through the pores or via the edge of the substrate. Thus, the more times the substrate is preheated, the less the electrode catalyst content is in the electrode catalyst layer on the back of the substrate to the electrode catalyst content in the electrode catalyst layer on the front of the conductive electrode substrate. By preheating the conductive electrode substrate, therefore, one can increase the ratio of the electrode catalyst content in the electrode catalyst layer on the front of the substrate to that on the back and, if necessary, can control how much to increase it.

[2-1 Preheating]

The conductive electrode substrate is preheated until the temperature of its front is equal to or higher than room temperature (ambient temperature, or normal temperature) in the preheating, preferably so that the temperature of the substrate is in the range from 35° C. to 120° C. immediately before the application as described hereinafter. Preferably, the heating temperature is below the boiling point of the solvent of the coating solution, which is, as described in more detail hereinafter, a solution containing a starting material for the electrode catalyst component in an inorganic or organic solvent. The conductive electrode substrate is heated to a temperature equal to or higher than room temperature before the coating solution is applied to the front of the substrate in the preheating step, and heating the substrate to a temperature equal to or higher than room temperature (ambient temperature, or normal temperature) beforehand in this way accelerates the evaporation of the solvent from the applied coating solution during the drying that follows the application, thereby effectively preventing the catalyst layer substance in the coating solution that adheres to the front of the substrate from migrating and being fixed to the back of the substrate. As a result, the amount of the catalyst component that is fixed to the back of the substrate is minimized.

As described hereinafter, preheating the conductive electrode substrate so that the temperature of the substrate is 35° C. or more immediately before the application, for example, results in at least 1.5 times more the electrode catalyst component adhering to the front of the substrate than to the back. Furthermore, as described hereinafter, a temperature of the preheated conductive electrode substrate of 100° C. immediately before the application corresponds to an at least 5-fold difference in the amount of adhesion of the electrode catalyst component between the front and the back of the substrate. However, increasing the temperature of the substrate beyond 100° C. makes little difference to the effect, and heating the substrate to a temperature higher than 120° C. is disadvantageous because it may cause the coating solution to dry so fast that the formation of the coating layer may be affected.

The inventor considers that the details of this principle are as follows. First, the reason why the amount of adhesion of the electrode catalyst component on the front of the substrate is increased compared to that on the back appears to be the following: the evaporation of the solvent of the coating solution is accelerated when a small amount of the solution comes into contact with the conductive electrode substrate because the substrate has been heated to a temperature equal to or higher than room temperature; the time given the coating solution to migrate (move) to the back of the substrate is reduced; as a result, the catalyst layer substance in the coating solution is rapidly fixed to the front, i.e., the coated side, of the substrate. Furthermore, increasing the preheating temperature also raises the temperature to which the conductive electrode substrate is heated, making the solvent of the coating solution evaporate faster and reducing the time the catalyst layer substance takes to be fixed to the front of the substrate. Thus, the fixation of the catalyst layer substance to the front of the substrate is accelerated, leading to an increased ratio of the amount of adhesion of the substance between the front and the back of the substrate. However, increasing the temperature of the conductive electrode substrate to as high as more than 120° C. may cause problems such as an explosive boiling of the coating solution, thereby increasing the possibility of negative effects unrelated to the amount of adhesion of the electrode catalyst component; too high a temperature of the substrate is disadvantageous.

Thus, preheating the substrate every time before the application is highly effective in increasing the ratio of the amount of adhesion of the electrode catalyst component on the front of the substrate to that on the back. More specifically, when forming an electrode catalyst layer on a conductive electrode substrate with a plurality of holes that is expanded mesh, a punched perforated plate, or wire netting or an object having a similar shape by applying a coating solution to the front of the substrate, one can maximize the ratio of the electrode catalyst content in the electrode catalyst layer on the front of the substrate to that in the electrode catalyst layer concurrently formed on the back by adding preheating of the substrate to the cycle of applying the coating solution to the substrate and subsequent drying and firing, or in other words by repeating a preheating-application-drying-firing cycle, so that the substrate is preheated every time before the coating solution is applied to its front.

This is not the only configuration possible in the present invention. As mentioned above, it is possible that the substrate is preheated only once and is not preheated after the application-drying-firing cycle is initiated. It is also possible to determine whether or not to preheat the substrate for each round of application to adjust the number of times of preheating in the repeated cycles. This configuration allows the electrode catalyst content in the electrode catalyst layers on the front and the back of the conductive substrate with a plurality of holes to be controlled as desired.

The heating means for the preheating is preferably an induction heater for reasons such as its high efficiency in generating heat and the fast temperature response of the substrate to it. Other heating means can also be used. Examples of other heating means for the preheating include those based on radiant heat, such as infrared light and radiant tubes, and exposing the conductive electrode substrate to hot air, and it is possible to appropriately apply these methods to preheating in accordance with the situation.

Induction heating (hereinafter abbreviated to IH) that is suitable in the present invention is the process of heating a metal or a similar conductive material as an object of heating by making use of a principle of electromagnetic induction, in which current is passed through a heating coil. The principle is as follows. Alternating current is passed through the heating coil, and magnetic field lines are produced with varying directions and intensities. A conductive material such as a metal is placed near the coil, and eddy currents are generated within the metal under the influence of the varying magnetic field lines. The resistance of the metal produces Joule's heat, $(\text{current})^2 \times \text{resistance}$, and the metal is self-heated. This process is referred to as induction heating, or IH. In the context of the present invention, the biggest advantage of using IH is that the conductive electrode substrate can be heated to a preset temperature in several seconds. The use of IH therefore allows the equipment for the preheating and that for the application to be located next to each other.

[2-2 Application]

The following describes an application step of applying a coating solution containing a starting material for the electrode catalyst component on the front of a conductive substrate with a plurality of holes. In the present invention, the coating solution is an inorganic or organic solution containing a starting material for the electrode catalyst component in an inorganic or organic solvent, and this coating solution is applied to the front of the preheated conductive electrode substrate to form a coating layer by means such as spraying. Applying the coating solution on the preheated substrate to form a coating layer provides the aforementioned great advantages of the present invention. Application means other than spraying, such as brushing and electrostatic coating, can also be used as a coating method in the application step.

The coating solution used in the present invention is a solution containing a starting material for the electrode catalyst component. It can be prepared by, for example, the following process.

For insoluble metal anodes, examples of starting materials for the electrode catalyst component include inorganic and organic compounds that contain at least one metal selected from platinum, iridium, ruthenium, palladium, and osmium. Such a compound, inorganic or organic one, is dissolved in an inorganic or organic solvent or any other suitable solvent to form an inorganic or organic solution, and this solution, containing the starting material, is used as the coating solution containing the starting material. Preferably, the coating solution is an inorganic or organic solution prepared by dissolving, in addition to the starting material for the electrode catalyst component, an inorganic or organic compound that contains valve metals such as titanium, tantalum, niobium, zirconium, and hafnium in an inorganic or organic solvent.

For insoluble metal cathodes, examples of preferred starting materials for the electrode catalyst component include, in addition to those presented above for insoluble metal anodes, compounds that contain rare earth elements such as lanthanum, cerium, and yttrium and also include hydrated oxalic acid.

Specific examples of compounds that can be used as the starting material for the electrode catalyst component include the following:

Platinum: chloroplatinic or platinum nitric acid compounds;

Iridium: iridium chloride;

Ruthenium: ruthenium chloride;

Palladium: palladium chloride;

Titanium: titanium chloride;

Tantalum: tantalum pentachloride;

Cerium: cerium chloride.

For example, the coating solution can be an inorganic solution that contains iridium tetrachloride and tantalum pentachloride in 35% hydrochloric acid. Other examples of solutions that can be used as the coating solution include an organic-inorganic solution obtained by dissolving ruthenium chloride, iridium chloride, and titanium chloride solutions dissolved in a mixture of hydrochloric acid and IPA (isopropyl alcohol), and an inorganic solution obtained by dissolving dinitrodiammine platinum and cerium nitrate in nitric acid.

When an anode for brine electrolysis is manufactured, the conditions of the coating in the present invention can be as follows, for example: the amount of the solution applied per round, 0.36 to 0.66 g; the number of rounds of application, 6 to 12; and the total amount of the solution applied, 2.16 to 5.28 g.

[2-3] Drying

The obtained coating layer is then subjected to drying and firing to form an electrode catalyst layer. The coating layer can be dried by any suitable process. For example, it can be dried at a preset temperature of 30° C. to 80° C. for 5 to 10 minutes following leveling in the drying zone of a continuous furnace located next to a coating booth. The drying, which comes after the application and before firing, is clearly distinguished from the preheating carried out in the present invention. The preheating in the present invention refers to heating the substrate prior to applying the coating solution to it.

[2-4 Firing]

The dried coating layer is finally subjected to firing to form an electrode catalyst layer that contains the electrode catalyst component (catalyst layer substance). The dried coating layer can be fired by any suitable process. For example, it can be fired in the firing zone of a continuous furnace located next to the drying zone of the same furnace. The dried coating layer can be fired under any suitable conditions, and the appropriate firing conditions depend on the sort of the electrode catalyst component used. For example, it can be fired at a temperature of about 350° C. to 600° C. for 10 to 15 minutes in the air.

Firing under such conditions thermally decomposes the starting material in the coating layer and produces an electrode catalyst layer. For anodes, an electrode catalyst layer is formed that contains an electrode catalyst component composed of, for example, at least one metal selected from platinum, iridium, ruthenium, palladium, osmium, and oxides thereof and/or alloys thereof, or may contain an electrode catalyst component composed of a composite oxide or solid solution that contains such a platinum-group metal and/or its oxide in combination with an oxide of valve metals such as titanium, tantalum, niobium, zirconium, and hafnium. For cathodes, an electrode catalyst layer is formed that contains a mixed oxide composed of any of the platinum-group metals listed above and/or its oxide in combination with an oxide of rare earth elements such as cerium and lanthanum.

(3. Downstream Operations)

As illustrated in FIG. 1, the method for manufacturing an electrolytic electrode according to the present invention may optionally include downstream operations such as performance adjustment, neutralization, and shaping after the electrode catalyst layer-forming step. Any downstream operations in the present invention can be performed in the same way as in the known method and are no different from those in the known method.

In this way, the manufacturing method according to the present invention allows one, when forming an electrode catalyst layer on a conductive substrate with a plurality of holes that is expanded mesh, a punched perforated plate, or wire netting or an object that has a similar shape, to ensure that the electrode catalyst layer on the front of the substrate contains more of the electrode catalyst component than that on the back and to control the ratio of the amount of the electrode catalyst component between the front and the back as desired, as described above, by adding preheating the substrate to a temperature equal to or higher than room temperature to the electrode catalyst layer-forming step and by presetting the temperature to which the substrate is preheated and/or how many times to preheat the substrate.

EXAMPLES

The following describes some examples of the present invention, however these examples should not be construed as limiting the present invention.

Example 1 and Comparative Example

1) Pretreatment Condition of a Conductive Electrode Substrate Made of Expanded Mesh and Used for Insoluble Metal Anodes As the conductive electrode substrate, a 300-mm square piece of titanium expanded mesh having a thickness of 1.0 mm and a specific surface area of 2.35 $m^2$ (actual surface area per 1 $m^2$ of projected area) was annealed while maintaining its actual temperature in the range of 580° C. to 600° C. for at least 1 hour. The surface of the conductive electrode substrate was then roughened by dry blasting using an aluminum abrasive (size: #60). The roughened conductive electrode substrate was then etched and washed in a 20% hydrochloric acid aqueous solution (at an azeotropic point) for about 12 minutes.

Thermocouples were welded on the surface of the pretreated conductive electrode substrate for 18-point temperature measurement. During the preheating, the temperature of the substrate was recorded and monitored at each of these points.

2) Conditions of Electrode Catalyst Layer Formation

[2-1 Preheating Condition of the Conductive Electrode Substrate]

On a coating conveyor, a 50-kW high-frequency power source and a heating coil having an effective heating length of 500 mm were placed 550 mm back from the point of robot-controlled coating. The conveyor speed was set at 1.8 m/min so that the conductive electrode substrate should be coated approximately 18 seconds after being heated.

The power source was configured for five different output levels as the heating condition of the conductive electrode substrate to be a target of heating: (1) the conductive electrode substrate was not heated (28° C., Comparative Example) or the substrate was preheated at a preset temperature of (2) 35° C., (3) 50° C., (4) 70° C., or (5) 100° C.

[2-2 Conditions of Application]

Ruthenium chloride, iridium chloride, and titanium chloride solutions as starting materials for the electrode catalyst component were dissolved in a mixture of hydrochloric acid and IPA to prepare an organic-inorganic mixed solution as a coating solution. The conductive electrode substrate heated to the specified temperature was conveyed into a coating booth, and the coating solution was applied by a spray over the surface of the substrate. The amount of the solution per round of application was determined so that the metal iridium content and the metal ruthenium content in the electrode catalyst layer would be roughly in the range from 0.4 to 0.7 g/m$^2$ each.

[2-3 Conditions of Drying]

The coating solution on the surface of the substrate was then dried by passing the substrate through the drying zone of a continuous furnace located next to the coating booth. The drying period was about 10 minutes, and the preset temperature was 60° C.

[2-4 Conditions of Firing]

The dried substrate was then fired in a furnace using an air-circulating gas-fired heater (about 470° C., about 10 minutes) so that the starting materials were thermally decomposed and formed a coating. In this way, an electrode catalyst layer was obtained that contained an electrode catalyst component composed of iridium oxide and ruthenium oxide.

The above-described application to firing operations were repeated six times to produce insoluble metal anodes. In producing the insoluble metal anodes, (1) the conductive electrode substrate was not heated (28° C., Comparative Example) or the substrate was preheated at a preset temperature of (2) 35° C., (3) 50° C., (4) 70° C., or (5) 100° C. before the coating solution was applied to the conductive electrode substrate.

3) After the electrode catalyst layer-forming step, the insoluble metal anodes proceeded to a step of downstream operations and were subjected to performance adjustment, in which the anodes were heated at about 500° C. for about 1 hour in the air for desired characteristics such as the single-electrode potential (SEP) and the oxygen content in chlorine gas during electrolysis. In this way, the insoluble metal anodes of Example 1 and Comparative Example were manufactured.

FIGS. 2 and 3 show the results of studies on these insoluble metal anodes according to Example 1 and Comparative Example. More specifically, FIGS. 2 and 3 represent the relation between the temperature of the conductive electrode substrates at each measurement point immediately before the coating solution was applied to their front and the ratio of the amount of adhesion of the electrode catalyst component on the front of the substrate to that on the back at that point.

FIG. 2 illustrates the ruthenium content in the electrode catalyst layer and shows the front/back ratio of the amount of adhesion of ruthenium versus the temperature of the conductive electrode substrates measured immediately before the application. FIG. 3 illustrates the iridium content in the electrode catalyst layer and shows the front/back ratio of the amount of adhesion of iridium versus the temperature of the conductive electrode substrates measured immediately before the application.

The amount of adhesion of the electrode catalyst component was measured by the following method:

Measuring instrument: ZSXmini, Rigaku Corporation;

Name of instrument: An X-ray fluorescence spectrometer;

Voltage-current: 40 kV-1.20 mA;

Mask diameter: ϕ30 mm.

As is clear from FIG. 2, a good correlation was observed between the temperature of the preheated conductive electrode substrates immediately before the application and the front/back ratio of the amount of adhesion of ruthenium. Statistical analysis gave the linear function (1) as an approximate equation.

$$y=0.070x-0.909$$

$$R^2=0.901 \quad (1)$$

Likewise, the temperature of the preheated conductive electrode substrates immediately before the application was in a good correlation with the front/back ratio of the amount of adhesion of iridium as can be clearly seen from FIG. 3. Statistical analysis gave the linear function (2) as an approximate equation.

$$y=0.080x-1.237$$

$$R^2=0.898 \quad (2)$$

The approximate equations (1) and (2) derived from FIGS. 2 and 3 were used to determine the front/back ratio of the amount of adhesion of ruthenium and that of iridium at the temperature of the unheated substrate, i.e., 28° C., and at each of the preset preheating temperatures. Table 1 summarizes the results. These results indicate that by presetting the preheating temperature, electrode catalyst layers on the front and the back of a substrate with different electrode catalyst content can be formed as desired.

TABLE 1

Point Temperature of Conductive Substrate and Front/Back Ratio of Amount of Adhesion of Metal

| Point temperature on the conductive substrate immediately before application (° C.) | Front/back ratio of the amount of adhesion: Ruthenium | Front/back ratio of the amount of adhesion: Iridium |
|---|---|---|
| 28 | 1.051 | 1.003 |
| 35 | 1.541 | 1.563 |
| 50 | 2.591 | 2.763 |
| 70 | 3.991 | 4.363 |
| 100 | 6.091 | 6.763 |

The following discusses these results in more detail. As is clear from Table 1 and FIGS. 2 and 3, for Comparative Example, in which (1) the conductive electrode substrate was not preheated (coated at about 28° C.), the ratio of the amount of adhesion of the electrode catalyst component on the front of the substrate, i.e., the coated side of the substrate, to that on the back was approximately 1; similar amounts of the electrode catalyst component adhered to the front and the back of the substrate. The ratio of the amount of adhesion on the front of the substrate to the back, the value on the vertical axis in FIGS. 2 and 3, rose with increasing temperature of the preheated substrate immediately before the application up to 100° C. as follows: (2) 35° C., approximately 1.5; (3) 50° C., 2.6 to 2.8; (4) 70° C., 4 to 4.4; (5) 100° C., 6 to 6.8. It was also found that the ratio of the amount of adhesion was substantially constant beyond 100° C.

As described above, the principle behind this appears to be as follows. The solvent in the coating solution evaporates when a small amount of the solution comes into contact with the conductive electrode substrate because the substrate has been heated to a temperature equal to or higher than room temperature. The grace period given for the electrode catalyst component to move on the surface of the substrate is eliminated, and the electrode catalyst component is fixed to the coated surface of the substrate. Increasing the temperature to which the conductive electrode substrate is heated makes the solvent evaporate faster and reduces the time the electrode catalyst component takes to be fixed, leading to an increased ratio of the amount of adhesion of the electrode catalyst component on the front and the back of the substrate. However, increasing the temperature of the conductive electrode substrate to as high as more than 120° C. may cause problems such as an explosive boiling of the coating solution.

In the present invention, a step of forming an electrode catalyst layer on a conductive electrode substrate includes preheating the substrate to a temperature equal to or higher than room temperature, and it is possible to control the temperature to which the substrate is preheated. As a result, this method has great advantages that the related art does not have: it ensures that the electrode catalyst layer on the front of the conductive substrate with a plurality of holes contains more of the electrode catalyst component than that on the back, and it also allows the ratio of the electrode catalyst content between the front and the back of the substrate to be controlled as desired.

Example 2

An insoluble cathode was manufactured in place of the insoluble metal anodes according to Example 1 in a way similar to that for the insoluble metal anodes in Example 1. A nickel wire netting that had the following characteristics was used as the conductive electrode substrate with a plurality of holes:

Nickel wire netting;

Specific surface area: 1.24 $m^2$ (actual surface area per 1 $m^2$ of projected area);

Thickness: 0.15 mm.

1) The conductive electrode substrate was pretreated by dry blasting on the surface using an aluminum abrasive (size: #320) and subsequent etching and washing in 20% hydrochloric acid for about 3 minutes.

The conductive substrate was then subjected to corrosion resistance enhancement, in which the substrate was heated at about 500° C. for not more than 30 minutes in the air.

2) The conductive substrate was then subjected to the electrode catalyst layer-forming step as follows.

[2-1 Preheating Conditions of the Conductive Electrode Substrate]

The pretreated conductive electrode substrate was preheated in away similar to that in Example 1. As in Example 1, the substrate was preheated every time before a coating solution was applied to it.

[2-2 Conditions of Application]

Cerium chloride and oxalic acid were dissolved in a ruthenium chloride solution to form an organic-inorganic coating solution similar to that used in Example 1. This coating solution was applied to the surface of the conductive substrate using a sponge roller. The amount of the solution per round of application was determined so that the ruthenium content in the electrode catalyst layer would be approximately 1.0 g/$m^2$ in terms of the amount of the metal oxide of ruthenium.

[2-3 Conditions of Drying]

The applied coating solution was then dried in an electric batch furnace at a preset temperature of 60° C. for about 5 to 10 minutes.

[2-4 Conditions of Firing]

The dried substrate was then fired in an electric muffle furnace (about 550° C., about 10 minutes) so that the starting materials were thermally decomposed and formed a coating. In this way, an electrode catalyst layer was formed containing an electrode catalyst component composed of ruthenium oxide and cerium oxide.

This cycle of preheating-application-drying-firing was repeated 12 times under the same conditions to produce an insoluble metal cathode.

3) The obtained insoluble metal cathode proceeded to a step of downstream operations and was subjected to performance adjustment, in which the cathode was heated at about 550° C. for about 1 hour in the air for a desired single-electrode potential (SEP).

As a result, even with a nickel wire netting as the conductive substrate, preheating the substrate before applying a coating solution to it successfully ensured that the electrode catalyst layer on the front of the substrate contained more of the electrode catalyst component than that on the back, and also allowed the ratio of the electrode catalyst content between the front and the back of the substrate to be controlled, as in Example 1.

In this way, it was verified that, the present invention, allows one, when forming an electrode catalyst layer on a conductive substrate with a plurality of holes that is expanded mesh, a punched perforated plate, or wire netting or an object that has a similar shape, to ensure that the electrode catalyst layer on the front of the substrate contains more of the electrode catalyst component than that on the back and to appropriately control the electrode catalyst content in the electrode catalyst layers on the front and the back of the substrate as desired by preheating the substrate to a temperature equal to or higher than room temperature in forming the electrode catalyst layer and by appropriately presetting the temperature to which the substrate is preheated.

INDUSTRIAL APPLICABILITY

Electrolytic cells are used in various industrial electrolytic processes that involve electrolytic sodium hydroxide production, water electrolysis, or oxygen or chlorine production, and the anode and the cathode of some electrolytic cells are produced using a conductive substrate with a plurality of holes that is expanded mesh, a punched perforated plate, or wire netting or an object that has a similar shape. The electrode catalyst component used is expensive because it is composed of a platinum-group metal and/or its oxide or a similar material. The present invention allows one, when manufacturing electrolytic electrodes using such a conductive substrate with a plurality of holes, to appropriately control the amount of an expensive electrode catalyst component, such as a platinum-group metal and/or its oxide, as desired and to minimize the consumption of expensive raw materials for the electrode catalyst component without affecting the functionality of the electrodes. The present invention therefore provides an efficient and cost-effective way to manufacture high-performance electrolytic electrodes, and it is hoped that the present invention will be widely used.

The invention claimed is:

1. A method for manufacturing an electrolytic electrode comprising:

forming an electrode catalyst layer comprising an electrode catalyst component on each of a front surface and a back surface of a conductive electrode substrate having a plurality of holes, the forming the electrode catalyst comprising:

applying a coating solution comprising a starting material of the electrode catalyst component to the front surface of the conductive electrode substrate, and thereafter drying and firing the coating solution, wherein the conductive electrode substrate is in at least one form selected from the group consisting of an expanded mesh, a punched perforated plate, and a wire netting, provided that the conductive electrode substrate is not a fired body obtained by firing metal powder or metal fiber and a metal woven fabric, the electrode catalyst layer formed on the back surface of the conductive electrode comprises the catalyst component in the coating solution that has been applied to the front surface of the conductive electrode and has migrated to the back surface of the conductive electrode by passing through the plurality of holes in the conductive electrode substrate, the conductive electrode substrate comprises at least one metal selected from the group consisting of titanium, tantalum, niobium, zirconium, hafnium, and nickel, and alloys thereof, a thickness of the conductive electrode substrate is in a range from 0.5 mm to 3.0 mm the electrode catalyst component comprises at least one material selected from the group consisting of platinum, iridium, ruthenium, palladium, osmium, and oxides thereof, in the forming the electrode catalyst layer, the conductive electrode substrate is at least once subjected to a preheating treatment in which the conducive electrode substrate is preheated to a preheating temperature higher than room temperature immediately before the applying the coating solution to the front surface of the substrate, and a ratio (AB) of an amount (A) of the electrode catalyst component adhering to the front surface of the conductive electrode substrate relative to an amount (B) of the electrode catalyst component adhering to the back surface of the conductive electrode substrate is controlled to be within a range from 1.5 to 6.8 by selecting the preheating temperature.

2. The method for manufacturing an electrolytic electrode according to claim 1, wherein the conductive electrode substrate immediately before the applying the coating solution is in a range from 35° C. to 120° C.

3. The method for manufacturing an electrolytic electrode according to claim 1, wherein the preheating temperature of the conductive electrode substrate immediately before the applying the coating solution is in a range from 35° C. to 70° C.

4. The method for manufacturing an electrolytic electrode according to claim 1, wherein the amount ratio (AB) of the amount (A) relative to the amount (B) is controlled to be a ratio within a range from 1.5 to 4.4.

5. The method for manufacturing an electrolytic electrode according to claim 1, wherein the amount (B) of the electrode catalyst component adhering to the back surface of the conductive electrode substrate and the amount ratio (A/B) are further controlled by selecting a number of times of the preheating treatment of the conductive electrode substrate in the electrode catalyst layer-forming step.

6. The method for manufacturing an electrolytic electrode according to claim 1, wherein the coating solution is an inorganic solution or an organic solution, in which the starting material is dissolved.

* * * * *